US007291796B2

(12) United States Patent
Liu et al.

(10) Patent No.: US 7,291,796 B2
(45) Date of Patent: Nov. 6, 2007

(54) PRESS SWITCH HAVING A FORCE-TO-DETACH FUNCTION

(75) Inventors: Chih-Song Liu, Taoyuan (TW); Fumiaki Miyaoka, Taoyuan (TW); Chih-Yang Chen, Taoyuan (TW); Hu-Chuan Wei, Taoyuan (TW)

(73) Assignee: Solteam Electronics Co, Ltd., Taoyuan, Taoyuan County (TW)

( * ) Notice: Subject to any disclaimer, the term of this patent is extended or adjusted under 35 U.S.C. 154(b) by 0 days.

(21) Appl. No.: 11/291,872

(22) Filed: Dec. 2, 2005

(65) Prior Publication Data

US 2006/0260924 A1 Nov. 23, 2006

(30) Foreign Application Priority Data

May 20, 2005 (TW) ..... 94208244 U

(51) Int. Cl.
*H01H 13/14* (2006.01)

(52) U.S. Cl. ..... 200/520; 200/341

(58) Field of Classification Search ..... 200/293, 200/302.1, 302.2, 314, 329, 333, 341
See application file for complete search history.

(56) References Cited

U.S. PATENT DOCUMENTS 6,275,133 B1 * 8/2001 Chen ..... 337/37
6,674,034 B1 * 1/2004 Wang ..... 200/341
6,680,449 B1 * 1/2004 Wang ..... 200/334
6,713,704 B1 * 3/2004 Yu ..... 200/520
2001/0013463 A1 * 8/2001 Asai et al. ..... 200/1 B
2003/0183498 A1 * 10/2003 Wang ..... 200/520

* cited by examiner

*Primary Examiner*—Elvin Enad
*Assistant Examiner*—Lisa Klaus
(74) *Attorney, Agent, or Firm*—Troxell Law Office, PLLC

(57) ABSTRACT

A press switch includes a base, a contractible pulling rod, an upper casing, and an actuator, and when the actuator is pressed to compress a resilient spring between the upper casing and the actuator, such that the contractible pulling rod and its press terminal move downward until two movable contact points are in contact with two fixed contact points of input/output terminal on both sides of the base to electrically connect to power supply If the actuator is released, the extension of the resilient spring lifts the contractible pulling rod and its press terminal, and thus the two movable contact points are forced to be detached from the fixed contact points of the input/output terminals on both sides, so as to disconnect the power supply. The invention can assure the safety of the use of an electric appliance product such a tool machine.

10 Claims, 6 Drawing Sheets

PRESS SWITCH HAVING A FORCE-TO-DETACH FUNCTION

BACKGROUND OF THE INVENTION

1. Field of the Invention

The present invention generally relates to press switches, and more particularly to a press switch having a force-to-detach function for assuring the safety of a use of electric appliances such as the use of a tool machine.

2. Description of the Related Art

A switch provided for electric connection has been used for years, and switches are a necessary device for controlling power supply. With the installation of a switch, we can disconnect a power supply as needed to prevent any accident caused by a continual use of power supply. The constantly connected power always keeps the power on and disconnects the power when the power is not needed. Therefore, all electric appliances and products require switches, and the basic operating principle of a switch is to electrically connect two electrodes to form a circuit for accessing electric power. If the two electrodes are not connected, the power will be disconnected, and thus the electric power cannot be accessed.

In general, a switch makes sure the connection and disconnection of electric power, and also takes safety into consideration. For example, electric leakages and wrong connections should be prevented. Tool machines such as electric drills, electric saws, or electric grinders involve a certain risk for their operations, and thus these machines adopt the constantly disconnected power. In other words, if the machines are not in use, their power is kept disconnected all the time. Such an arrangement assures that the machine is not operable without electric power supply when they are not in use and assures the safety of the operators. However, the tool machine produces a high temperature due to the high current or repeated contacts, and the two contact points may be melted or become a sticky status, and thus causing a short circuit to the tool machines. Since most constantly disconnected power measures use a single point for the electric contact, therefore the sticky contact terminals cannot be detached from each other, and it will jeopardize the safety of users. Therefore, finding a way of improving the press switch structure having a force-to-detach function and solving the problem of a short circuit of the tool machines caused by the sticky contacts, the high current, or repeated contact under a high temperature of operation demands immediate attentions and feasible solutions.

SUMMARY OF THE INVENTION

In view of the foregoing shortcomings of the prior art, the inventor of the present invention based on years of experience in the switch and electric product industry to conduct extensive researches and experiments, and finally invented the "press switch having a force-to-detach function" in accordance with the present invention.

The primary objective of the present invention is to provide a press switch having a force-to-detach function, and the press switch comprises: a base, which is a hollow base having an open top and including at least one chamber for accommodating and positioning input/output terminals of an electrode device, and the terminals come with a fixed contact point, and an electric conducting pillar disposed between the fixed contact points; a contractible pulling rod, having a press rod at its top and a driven plate extended transversally in middle and coupled with at least one press terminal, and both ends of the terminal have a movable contact point separately and correspondingly disposed under the two fixed contact points, and the contractible pulling rod and the press terminal are coupled to a pair of electric conducting pillars for being moving up and down; an upper casing for covering and sealing the base and allowing the press rod to be protruded from its top, and having a support axle section disposed at one end; and an actuator, having an end coupled with the support axle section and an internal wall coupled to the press rod, and a resilient spring is installed between the upper casing and the actuator. Therefore, if the actuator is pressed, the resilient spring is pressed as well to move the contractible pulling rod and its press terminal downward until the two movable contact points are in contact with the input/output terminals of the fixed contact points on both sides respectively to electrically connect with the power supply If the actuator is released, the resilient spring is stretched to lift the contractible pulling rod and its press terminal, such that the two movable contact points are forced to detach from the input/output terminal of the fixed contact points on both sides, so as to disconnect the power supply.

The second objective of the present invention is to provide a press switch structure having a force-to-detach function, and the press switch comprises an arc bracket disposed between an external side of the press terminal and the electric conducting pillar, and the movable end of the arc bracket changes its action due to a transversal displacement, such that after the contractible pulling rod and the press terminal go beyond their critical points, the arc bracket changes its curvature and produces an elastic pressing force to tightly contact or detach two fixed contact points on both sides, so as to connect or disconnect the power supply.

Another objective of the present invention is to provide a press switch structure having a force-to-detach function that further comprises an accessory resilient mechanism installed between two electric conducting pillars and disposed vertically and alternately, and the mechanism includes a contractible spring with both ends connected separately to a sliding member, and the two sliding members are accommodated between a bracket stand of the contractible pulling rod and having a pair of conical members protruded from its interior, such that the aslant side of the conical member is pushed and squeezed by the two sliding members to produce kinetic energy for an instant upward movement, so as to separate the two movable contact points from the two fixed contact points.

A further objective of the present invention is to provide a press switch having a force-to-detach function that further comprises a latch device, and the device is axially connected to a movable end of the actuator by a flip button, and one of its sides is connected to a contractible spring pressing on the internal wall of the actuator, and the other side has a button hook extended downward, such that when the flip button is turned, the button compresses the contractible spring, and the button hook on the other side is extended deeply into a latch groove disposed vertically on the upper casing to hook the actuator with the upper casing, and the actuator cannot be bounced back.

BRIEF DESCRIPTION OF THE DRAWINGS

To further disclose the technical characteristics of the present invention, the following drawings are provided for illustration.

DETAILED DESCRIPTION OF THE PREFERRED EMBODIMENTS

Figure 1:
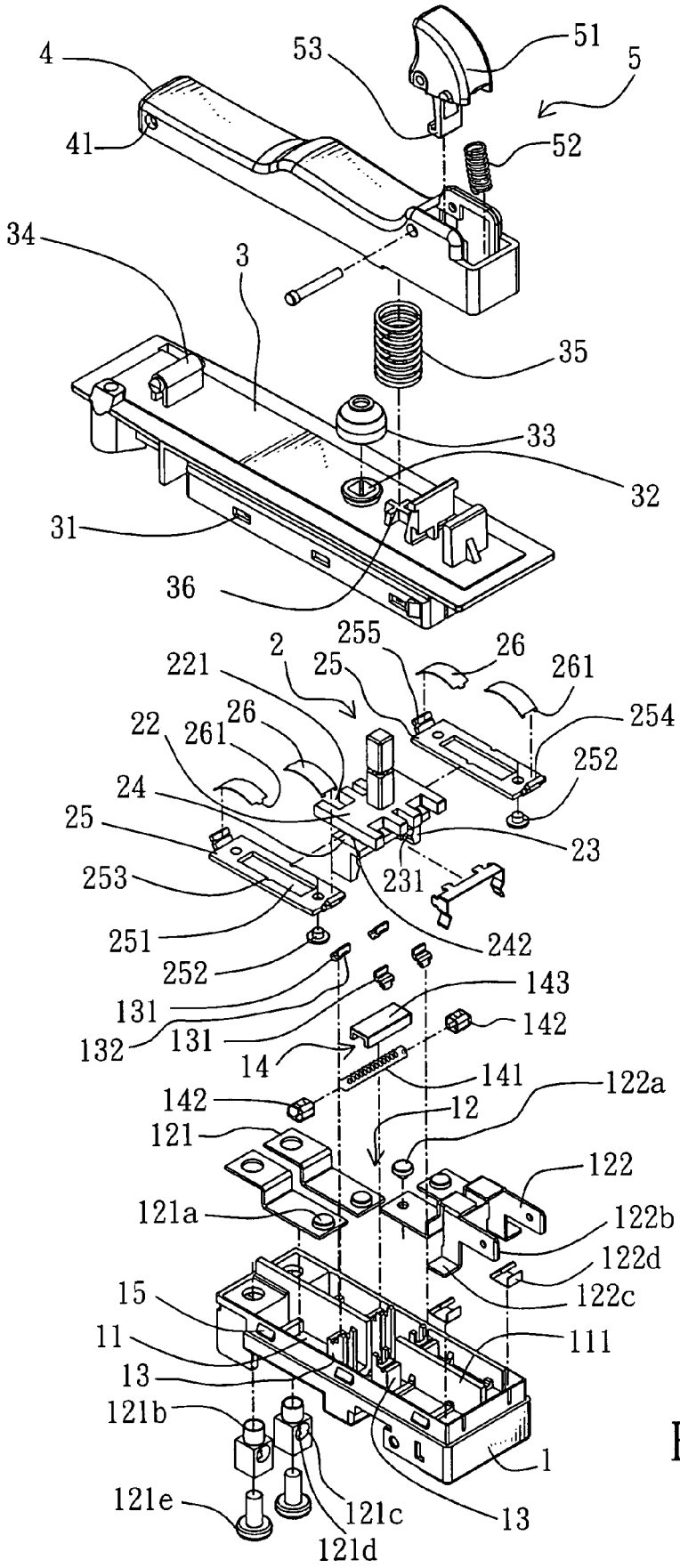
FIG. 1 is a perspective view of a press switch of the present invention.

Referring to FIGS. 1 to 4, a press switch of the present invention comprises a base 1, a contractible pulling rod 2, an upper casing 3, and an actuator 4.

The base 1 is a hollow base having an open top and a long transversal chamber 11 for accommodating and fixing an electrode device 12. A circuit is defined as shown in the figure, such that the chamber 12 is divided into a front section and a rear section by a partition 111. However, the invention is not limited to such arrangement, but a three-phase power control switch can be formed by using two parallel partitions as well. This is a prior art, and thus will not be described here. For simplicity, only a set of electrodes are used for illustrations here. Both ends of the chamber 11 at the front section accommodates and fixes an input terminal 121 and an output terminal 122 of an electrode device 12. The internal sides of the input terminal 121 and output terminal 122 includes a fixed contact point 121*a*, 122*a* at their corresponding ends, and a pair of electric conducting pillars 13 are vertically disposed between the input terminal 121 and output terminal 122 for coupling with the contractible pulling rod 2, and the contractible pulling rod 2 can displace vertically between the two electric conducting pillars 13.

A wire conducting base 121*b* is connected to an external side of the input terminal 121, and the exposed end of a power cable is inserted into a transversally disposed wire hole 121*c*, and a connecting component 121*e* such as a screw is passed through the wire hole 121 and vertically connected to a connecting hole 121*d* for pressing the exposed end, such that the exposed end is fixed into the wire conductive base 121*b*, and the power of an external power supply is supplied to the input end 121. A connecting section 122*b* at the external side of the output terminal 122 is extended out of the base 1 to facilitate the terminal of the power cable in the tool machine to be connected quickly. In addition, the output terminal 122 has a vertically extended L-shape pressing section 122*c* for pressing a triangular elastic member 122*d* in a groove at the bottom of the chamber 11, such that the output terminal 122 has the capability of elastically displacing along the vertical direction.

The contractible pulling rod 2 has a press rod 21 at the top, and an actuator 22 transversally extended from the middle, and an n-shape bracket stand 23 at the bottom for defining a gap 24 therebetween. A tenon 241 (which is not shown in the figure) is protruded from the top of the bracket stand 23 in the gap 24 to pass through and couple to a long bracket groove 251 of a press terminal 25. Both ends of the press terminal 25 includes a movable contact point 252 protruded downward from both ends of the press terminal 25 to be in contact or separated from the foregoing fixed contact points 121*a*, 122*a*. To prevent the press terminal 25 from moving towards both sides, the gap 24 and the tenon 241 include a rib 242 for latching with a rib groove 253 of the press terminal 251, so that the press terminal 25 cannot be moved sideway.

Figure 2:
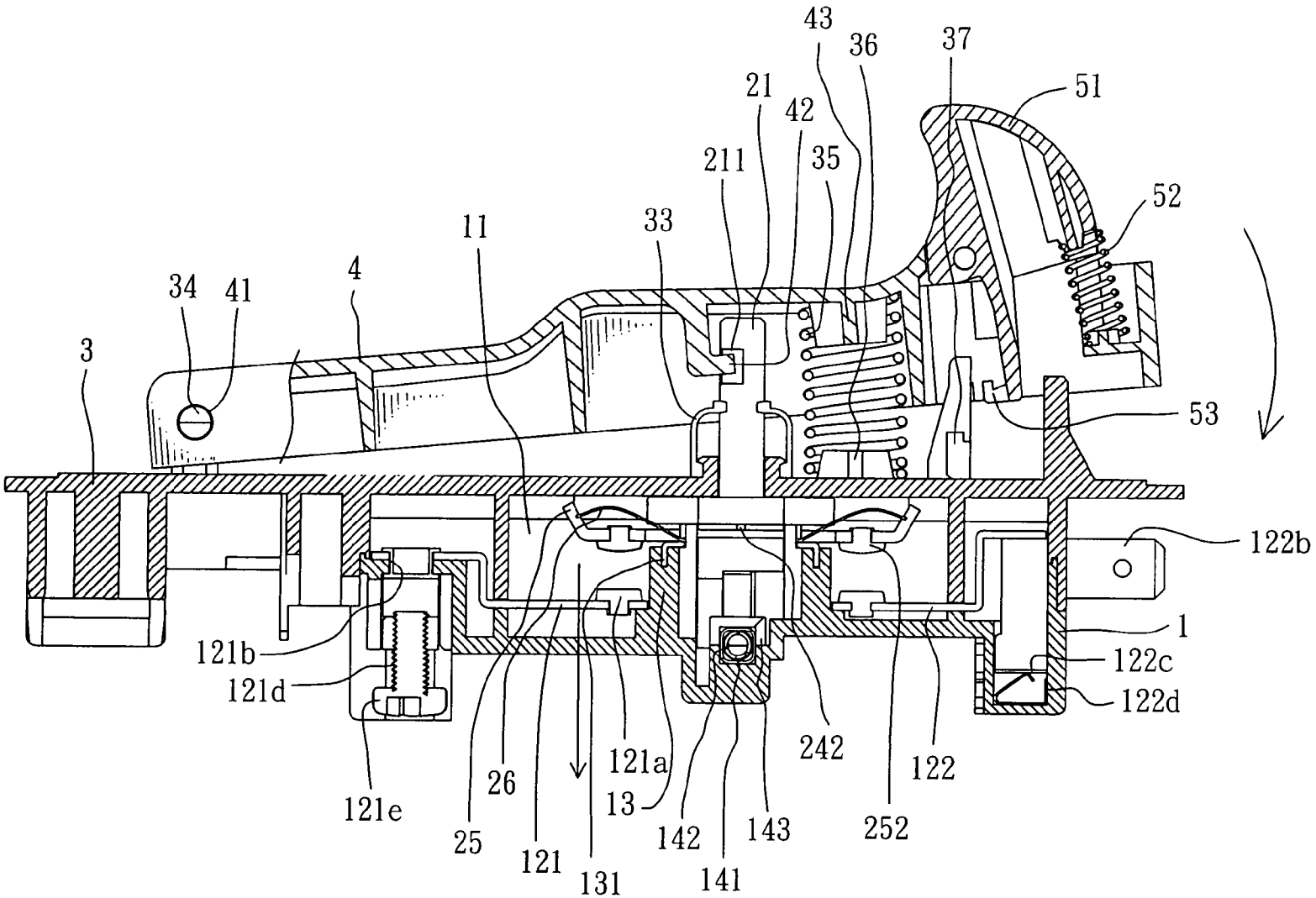
FIG. 2 is a cross-sectional view of a disconnected switch of the present invention.
Figure 3:
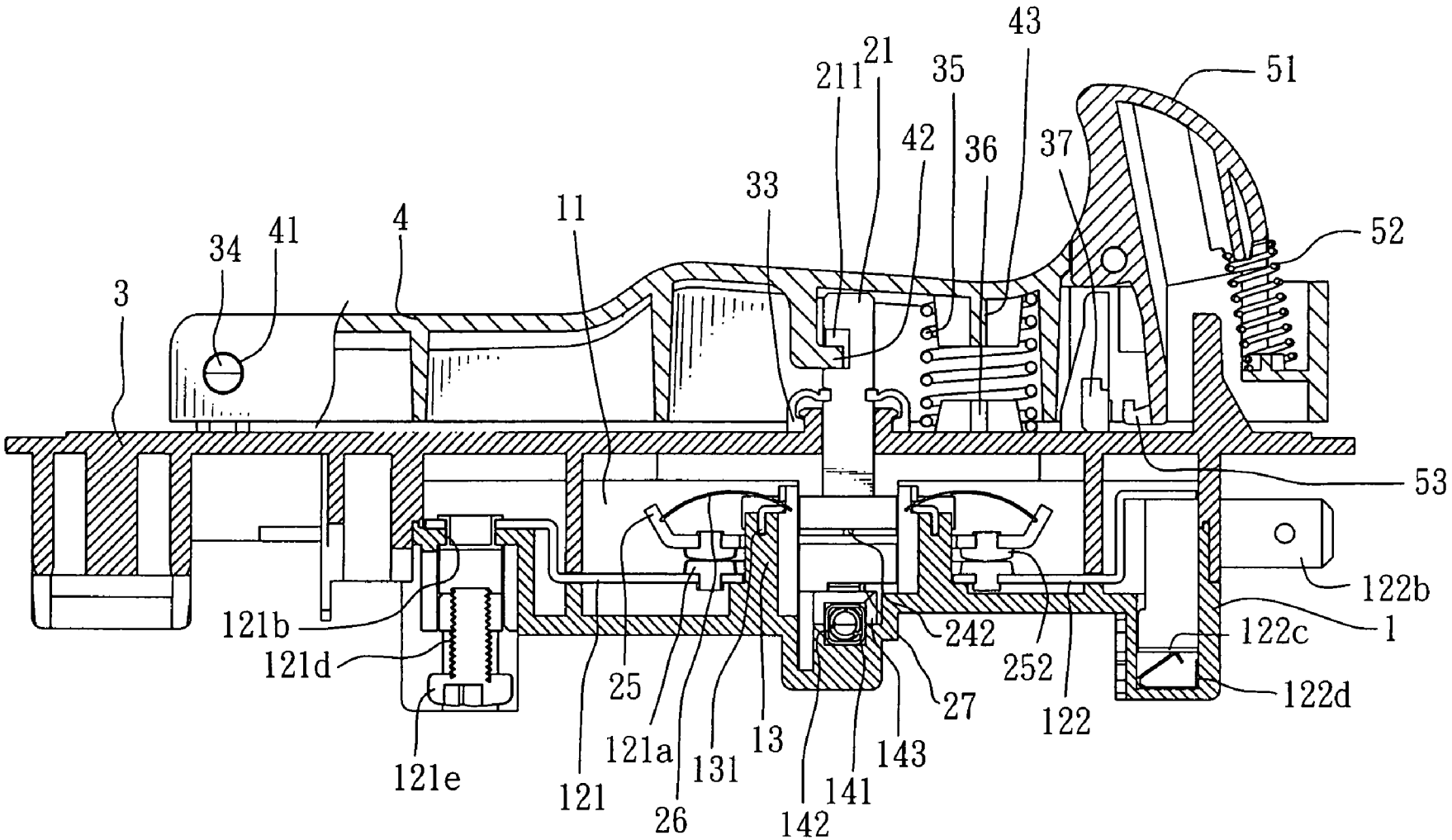
FIG. 3 is another cross-sectional view of a connected switch of the present invention.
Figure 4:
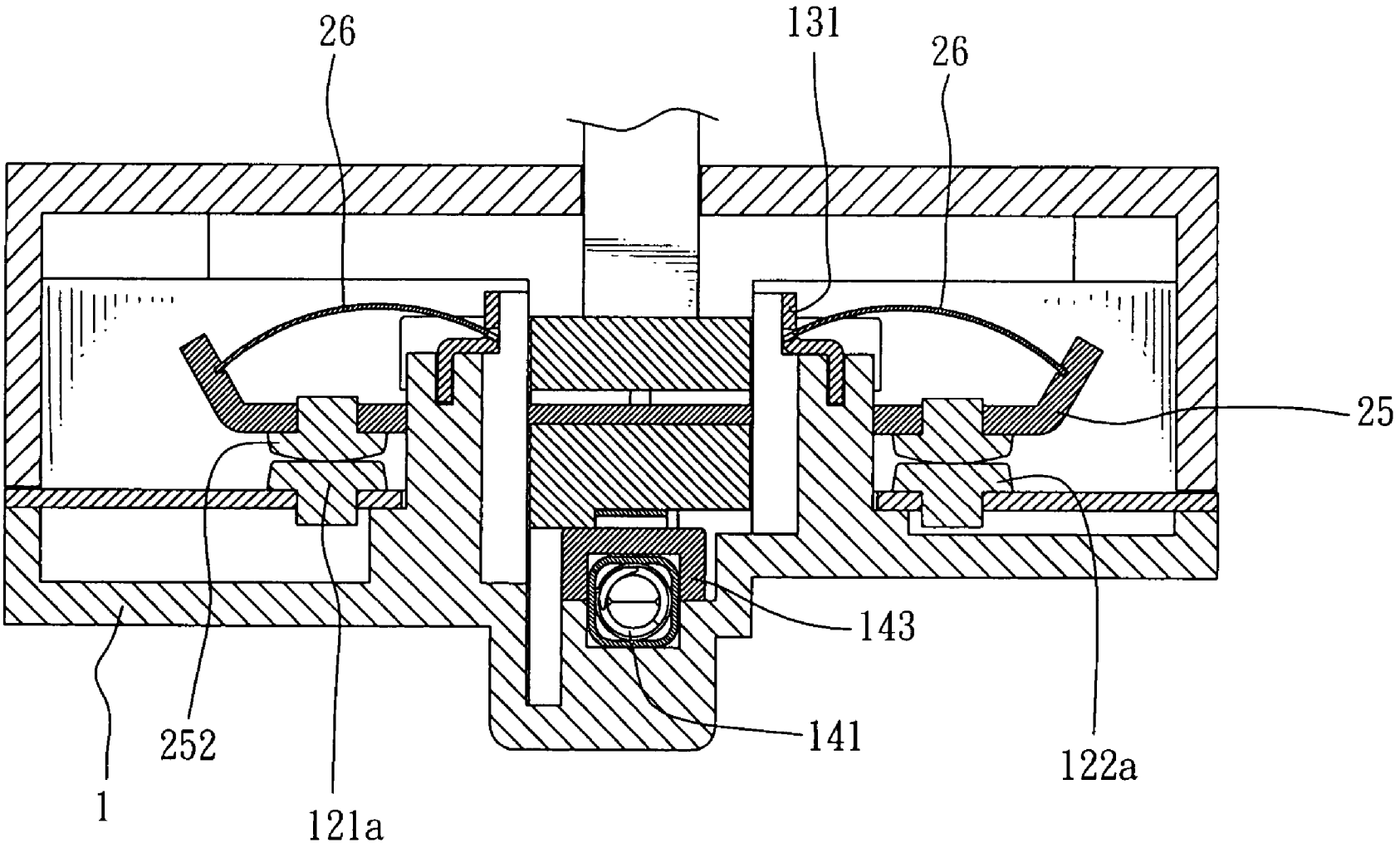
FIG. 4 is an enlarged cross-sectional view of a base and a contractible pulling rod of the present invention.

In the figure, the rib groove 253 is disposed at the edge of the press terminal 25 and/or in the middle section of the internal side of the bracket groove 251. The actuator 22 forms a concave electric conducting groove 221 at the corresponding positions of the electric conducting pillars 13, and thus the two electric conducting grooves 221 and the bracket groove 251 define a hollow for easily connecting the contractible pulling rod 2 to the electric conducting pillar 13, and successfully displacing the contractible pulling rod vertically. To provide an action of automatically forming a pressing force and an elastic force downward at a critical point during the process of displacing the contractible pulling rod 2, an arc bracket 26 is installed between the external side of the press terminal 25 and the electric conducting pillar 13. Referring to FIG. 2, if no force is exerted onto the contractible pulling rod 2, the movable end of the arc bracket 26 (which is the external side of the press terminal 25) is slightly higher than its fixed end (which is the top of the electric conducting pillar), and the curvature of the arc bracket 26 is smaller. Referring to FIGS. 3 and 4, if a force is exerted on the contractible rod 2 to move the press terminal 25 downward and pass a critical point, the arc bracket 26 has a larger curvature due to the deformation and exerts a pressure on the press terminal 26 to form a downward elastic force. By that time, the movable end of the arc bracket 26 is slightly lower than the fixed end, so that the movable contact points 252 on both sides of the press terminal 25 separately and tightly press the fixed contact points 121*a*, 121*b* of the input terminal 121 and output terminal 122, so as to electrically connect the power supply. To improve the strength and rigidity of the top of the electric conducting pillar 13, a metal fixed plate is installed at the top of the electric conducting pillar 13, and a wing plate 254 is disposed aslant towards the external side of the press terminal 25, and both have a latch groove for latching the latches 261 protruded from both sides of the arc bracket 26 to secure the connection.

Figure 5:
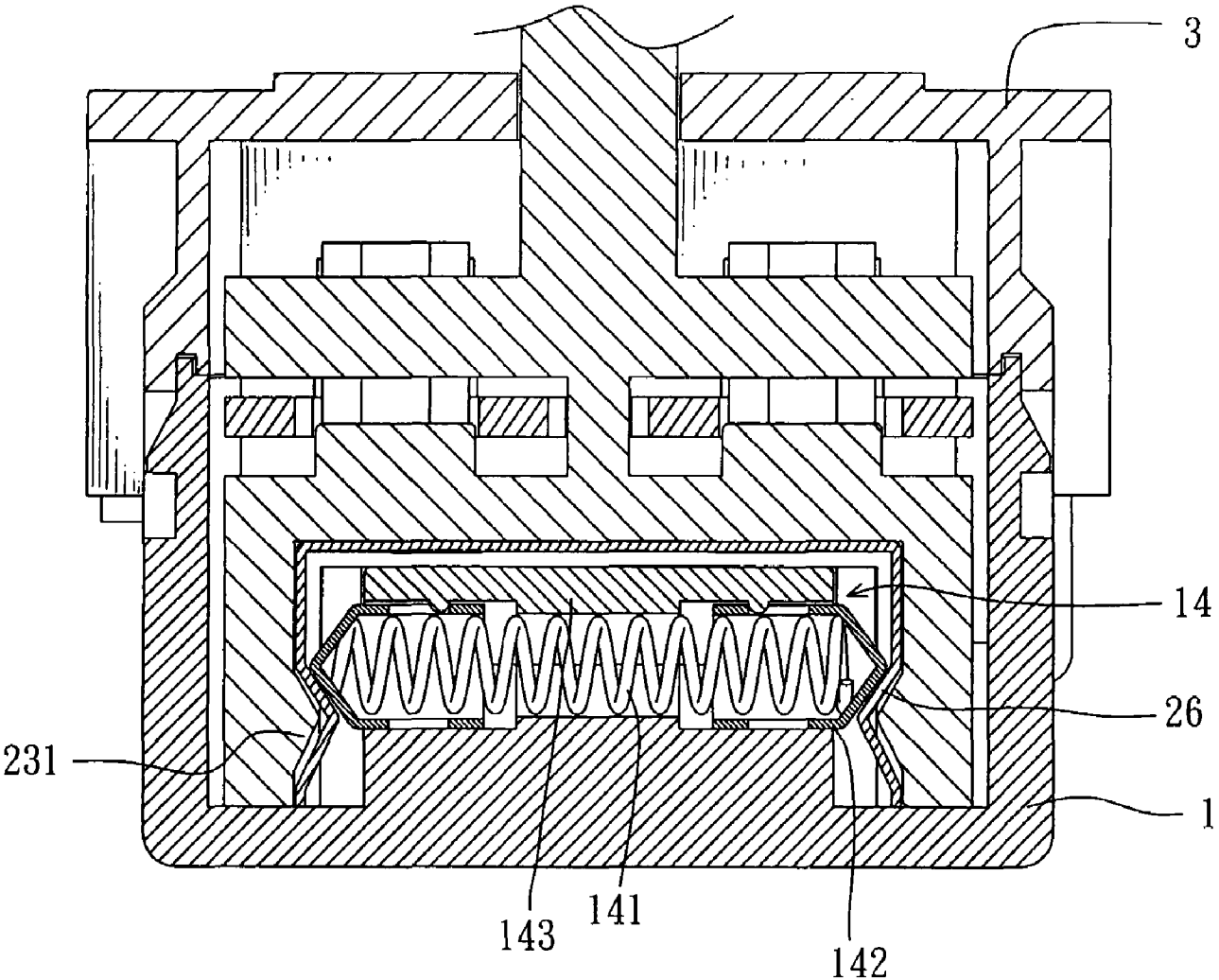
FIG. 5 is another enlarged cross-sectional view of a base and a contractible pulling rod of the present invention.

Referring to FIGS. 1 and 5, the present invention comprises an accessory resilient mechanism 14 disposed between two electric conducting pillars 13 vertically and alternately, and the mechanism 14 includes a sliding member 142 coupled to both ends of a contractible spring 141, wherein the accessory resilient mechanism 14 is coupled to the chamber 11 by a sealed cover 143 for defining an activity space between the contractible spring 141 and two sliding members 142. The two sliding members 142 are accommodated between the bracket stand 23, and a conical member 231 is protruded from the interior of the bracket stand 23, such that when the contractible pulling rod 2 is pressed, the bottom of the conical member 231 pushes the sliding member 142 to compress the spring 141 until the bottom of the bracket stand 23 is in contact with the bottom of the chamber 11. If the spring 141 is stretched, the sliding member 142 is resided at the top of the conical member 231. However, when the contractible spring 2 is stretched by the resilient spring 35 to move upward, the aslant side of the conical member 231 is pressed by the two sliding members 142 to produce kinetic energy for an instant upward movement, which facilitates the separation of the two movable contact points 252 from two fixed contact points 121*a*, 122*a*, and the contact points will not be melted easily. In addition, a metal fixed stand 27 can be embedded to the bracket stand 23 of the contractible pulling rod 2 to improve the strength and rigidity of the bracket stand 23.

The upper casing 3 covers and seals the base 1. For instance, a hook 15 and a latch groove 31 are provided for connecting the upper casing 3 and the base 1, but the invention is not limited to such arrangement. The upper casing 3 includes a penetrating hole 32 disposed corresponding to the top of the contractible pulling rod 2 for extending the contractible pulling rod 2. To prevent dust from entering into the base 1, a dustproof cover 33 covers the penetrating hole 32, and the dustproof cover 33 also has a hole for extending the contractible pulling rod 2, so as to prevent a short circuit caused by the dust. A support axle section 34 is protruded from an end of the upper casing 3 and axially coupled to an actuator 4. A resilient spring 35 is installed at a positioning tenon 36, 43 disposed between the upper casing 43 and the actuator 4, such that the actuator 4 is extended outward when the actuator 4 is not in use.

The actuator 4 is a long handle and an axial hole 41 at one end is axially coupled to the support axle 34 and a handle hook 42 is disposed at the position corresponding to a slot 211 at the top of the press rod 21 and hooked together. The height of the slot 211 is slightly larger than the handle hook 42, so that a gap is formed between the slot 211 and the handle hook 42. In FIG. 2, the hook handle 42 is hooked on the top edge of the slot 211 when the actuator 4 is not operated, so that the whole contractible pulling rod 2 is lifted by the extension of the actuator 4. In FIG. 3, the actuator 4 is pressed to displace the gap and press the lower edge of the slot 211. By that time, the contractible pulling rod 2 is also pressed to move downward.

Figure 6:
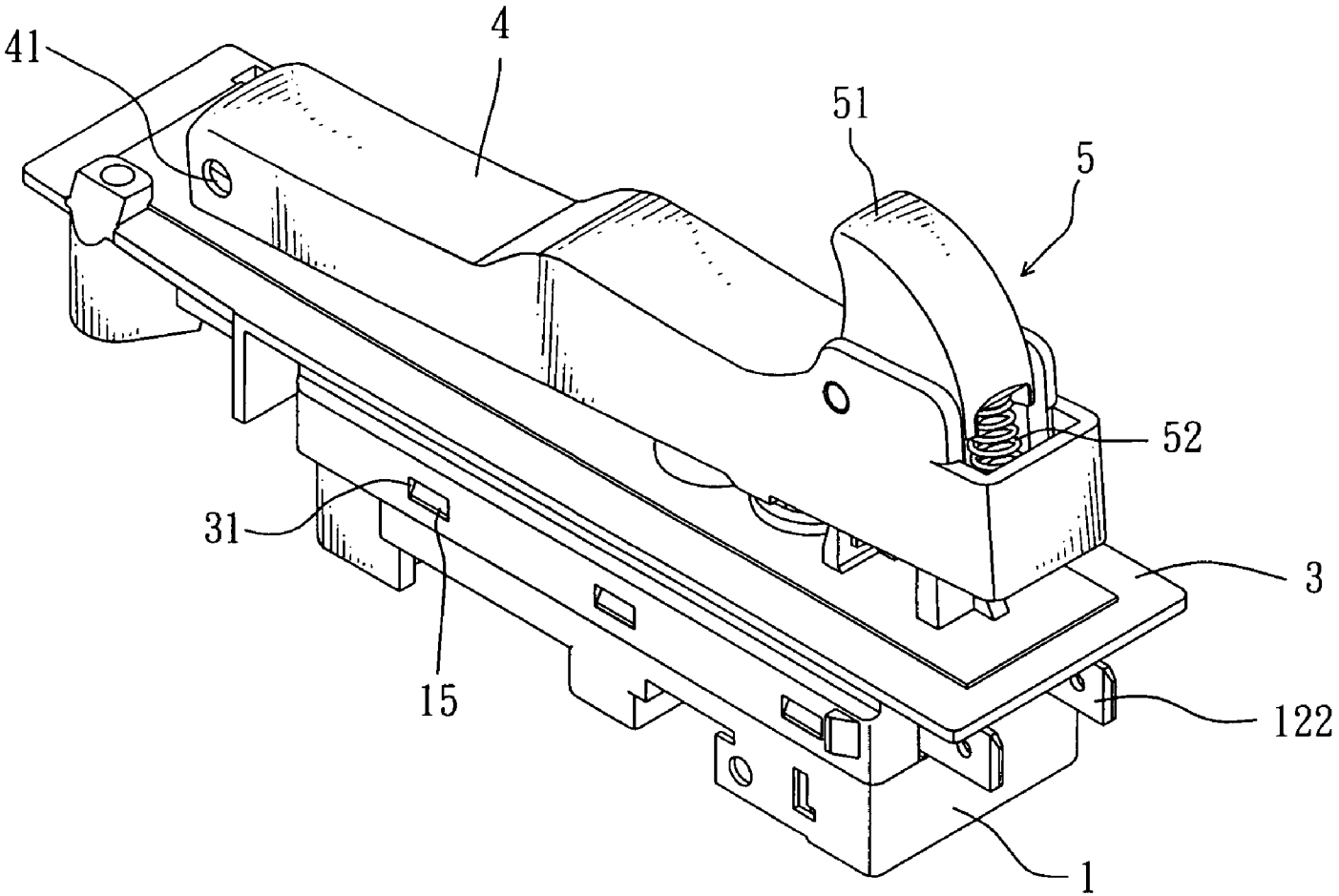
FIG. 6 is a perspective view of the present invention.

Taking the long time use of the switch into consideration, the present invention further comprises a latch device 5 for axially connecting a movable end of the actuator 4 by a flip button 51, and one end of the latch device 5 presses the extended spring 52 at the internal wall of the actuator 4, and a hook button 53 is extended downward from the other side. If the flip button 51 is turned, the extended spring 52 is compressed, and the button hook 53 at the other end is extended deeply into the latch groove 36 vertically disposed on the upper casing 3, such that the actuator 4 will not bounced back since it is hooked to the upper casing 3, and thus the press switch maintains electrically connected. With the description and analysis of the principle of the foregoing components, the space configuration established by the assembly of the present invention is shown in FIG. 6.

Referring to FIGS. 2 and 3, the actuator 4 is pressed for the operation, so that the contractible pulling rod is moved downward, and the two arc brackets 26 change their actions due to the vertical displacement of the movable end. After it goes beyond the critical point, the curvature will be changed to produce a pressing force and an elastic force, so that each movable contact point 252 is tightly in contact or separated from the fixed contact point 121*a*, 122*a* so as to connect or disconnect the power supply. On the other end, the actuator 4 is released when the switch is not in use, the extension of the resilient spring 35 drives the actuator 4 to lift the whole contractible pulling rod 2, so as to disconnect the power supply.

Since the movable contact points are disposed on both ends of the press terminal under the contractible pulling rod to electrically connect the power supply, the two movable contact points must be in contact with the fixed contact point of the input/output terminals. If any one set of the movable and fixed terminals is melted, another set of the movable and fixed terminals can be lifted by the contractible pulling rod and the press terminal according to the extension of a resilient spring to produce the expected force-to-detach effect. In addition, two corresponding arc brackets change their actions due to the vertical displacement of the movable ends, so that after the contractible pulling rod and press terminal pass a critical point, the curvature will be changed to produce a pressing force and an elastic force. As a result, the movable contact points can be tightly in contact or separated from the fixed contact points on both sides, so as to connect or disconnect the power supply. The present invention further comprises an accessory resilient mechanism for providing kinetic energy to facilitate separating the movable contact points from the fixed contact points. The present invention further comprises a latch device for keeping the press switch electrically connected. Such arrangement is an innovative breakthrough of press switches.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A press switch having a force-to-detach function, comprising:

a base, being a hollow base and having an open top, and including at least one chamber for accommodating and fixing input and output terminals of an electrode device, and each terminal of the input and output terminals includes a fixed contact point and a pair of electric conducting pillars being disposed therebetween;

a contractible pulling rod, having a press rod at a top, an actuator transversally extended from a middle section of the contractible pulling rod and coupled with at least one press terminal, and a movable contact point being separately disposed on each of two opposing ends of the at least one press terminal and corresponding to one of two fixed contact points of the input and output terminals, and said contractible pulling rod and the at least one press terminal being coupled to a pair of electric conducting pillars for being lifted;

an upper casing, for covering and sealing said base, and having a press rod being extended from a top and a support axle section being disposed at an end; and an actuator, having an end axially coupled to said support axle section and an internal wall coupled to said press rod, and a resilient spring being disposed between said upper casing and said actuator;

such that if said actuator is pressed to compress said resilient spring, said contractible pulling rod and the at least one press terminal move downward until each movable contact point is in contact with said fixed contact points of said input and output terminals on opposing sides of the base to electrically connect to a power supply; if said actuator is released, an extension of said resilient spring lifts and contractible pulling rod and a press terminal thereof, so as to force two movable contact points to be detached from said two fixed contact points of said input and output terminals, so as to disconnect from the power supply.

2. The press switch having a force-to-detach function of claim 1, wherein said input terminal has an external side coupled to a wire conducting base, and a transversally disposed wire hold, and a connecting component is passed through a connecting hole vertically interconnected with said wire hole for connecting to the power supply, and a connecting section disposed at an external side of said output terminal is extended from said base, and having a pressing section extended from a vertical direction for pressing an elastic member disposed in a groove at a bottom of said at least one chamber of the base.

3. The press switch having a force-to-detach function of claim 1, wherein said actuator of said contractible pulling rod and a bottom of a bracket stand of said contractible pulling rod include a gap, and a tenon is disposed at a top of said bracket stand for passing and coupling a bracket groove of the at least one press terminal, and said gap and said tenon include a rib for latching a rib groove disposed at a position corresponding to said at least one press terminal.

4. The press switch having a force-to-detach function of claim 1, further comprising an arc bracket disposed between an external side of said at least one press terminal and each of said pair of electric conducting pillars, and a movable end of said arc bracket changes action due to a vertical displacement, such that after said contractible pulling rod and said at least one press terminal pass a critical point a curvature of each arc bracket is changed to produce a pressing force and an elastic force, and each of said two movable contact points is tightly in contact or separated from said two fixed contact points on the opposing sides of the base, so as to selectively connect and disconnect the power supply respectively.

5. The press switch having a force-to-detach function of claim 4, wherein each of said pair of electric conducting pillars includes a metal fixing plate embedded at a top of each of said pair of electric conducting pillars, and said metal fixing plate and an external side of said at least one press terminal include a latch groove, so as to latch with tenons protruded from opposing sides of said arc bracket.

6. The press switch having a force-to-detach function of claim 1, further comprising an accessory resilient mechanism installed between said two electric conducting pillars and disposed vertically and alternately, and said accessory resilient mechanism is connected to one of two sliding members disposed separately on each of two ends of said contractible pulling rod, and said two sliding members are accommodated between a bracket stand of said contractible pulling rod, and having a conical member protruded from an interior, such that an aslant side of said conical member is pushed by said two sliding members to produce kinetic energy for an instant upward movement, so as to assist separating said two movable contact points from said two fixed contact points.

7. The press switch having a force-to-detach function of claim 6, wherein said bracket stand includes a metal fixing stand embedded at an internal periphery of said bracket stand, and said accessory resilient mechanism is coupled to said chamber with a seal cover for defining an activity space for said contractible spring and said two sliding members.

8. The press switch having a force-to-detach function of claim 1, wherein said upper casing includes a penetrating hole disposed thereon and covered by a dustproof cover, and said dustproof cover includes a hole for extended said contractible pulling rod.

9. The press switch having a force-to-detach function of claim 1, wherein said actuator includes a handle hook disposed on an internal wall of said actuator and accommodated in a slot at a top of said press rod.

10. The press switch having a force-to-detach function of claim 1, further comprising a latch device axially coupled with a movable end of said actuator by a flip button and having an end pressing an extended spring at an internal wall of said actuator, and a button hook extended downward from another end, such that if said flip button is turned, said extended spring is compressed, and said button hook at the other end is extended deeply into a latch groove disposed vertically on said upper casing, so that said actuator is hooked to said upper casing and is not bounced back.

* * * * *